US006692368B1

(12) United States Patent
Hyun

(10) Patent No.: US 6,692,368 B1
(45) Date of Patent: Feb. 17, 2004

(54) SWING

(75) Inventor: Jong Woo Hyun, Hindol Maeul (KR)

(73) Assignee: Keymax Co., Ltd., Kyunggi-Do (KR)

( * ) Notice: Subject to any disclaimer, the term of this patent is extended or adjusted under 35 U.S.C. 154(b) by 0 days.

(21) Appl. No.: 10/345,833

(22) Filed: Jan. 16, 2003

(51) Int. Cl.[7] ..... A63G 9/16
(52) U.S. Cl. ..... 472/119; 472/125; 5/108
(58) Field of Search ..... 472/118, 119, 472/125; 297/273; 5/108, 109

(56) References Cited

U.S. PATENT DOCUMENTS 3,261,032 A * 7/1966 Reardon ..... 5/108
3,842,450 A * 10/1974 Pad ..... 5/109
4,449,831 A * 5/1984 Itami et al. ..... 368/165
5,307,531 A * 5/1994 Kao ..... 5/108

* cited by examiner

*Primary Examiner*—Kien T. Nguyen
(74) *Attorney, Agent, or Firm*—IP Strategies, P.C.

(57) ABSTRACT

An infant's swing is disclosed. The swing is driven by an electric power to automatically operate the swing. The frame is A-shaped in a side view, and a pair of oscillation shafts are secured to a pair of securing bars respectively, the securing bars being installed in the peak portions of the frame 12 respectively. A pair of magnet boxes are provided to contain a pair of securing bars and a pair of electromagnets in each of them, and an oscillator is disposed between each pair of the electromagnets. An electric power is supplied alternately to the electromagnets to alternately magnetize them, thereby making the oscillators swing leftward and rightward.

4 Claims, 4 Drawing Sheets

SWING

FIELD OF THE INVENTION

The present invention relates to an infant's swing. Particularly, the present invention relates to an infant's swing in which a pair of oscillators are installed on the peaks of an A type frame (which supports a pair of oscillation shafts) respectively, and an electric current is supplied alternately to two sets (two pairs in each set) of electromagnets to make the two sets of the electromagnets alternately magnetized, so that the oscillation shafts and the oscillators would perform reciprocating movements, thereby making it possible to set the swing as to the time and the velocity.

BACKGROUND OF THE INVENTION

Generally, an infant's swing is oscillated with a human hand, but the manual swinging is very troublesome, while it is impossible to do other works during the caring of the infant.

SUMMARY OF THE INVENTION

It is an object of the present invention to provide an infant's swing in which a pair of oscillators disposed between two sets (two pairs) of electromagnets respectively; if an electric power is supplied to one of the electromagnets, then the oscillator is pulled toward the electrified electromagnet; and if the oscillator moves to a certain distance toward the electrified electromagnet, then the mentioned electromagnet loses the magnetic fluxes, and at the same time, the electric power is supplied to the other electromagnet so as to pull the oscillator in the opposite direction, this being repeated to make the swing continuously swung.

Thus the swing seat which is interlocked to the oscillator can be made swung for a predetermined period of time and at a predetermined velocity.

The power supplied to the swing of the present invention is a DC power so as to prevent any electrification of the infant. When outgoing with the swing carried, a battery is used as the power source.

In addition to the time and velocity of the swing, other functions are also provided such that if the infant cries, then the swing is activated or music is outputted in an automatic manner.

BRIEF DESCRIPTION OF THE DRAWINGS

The above object and other advantages of the present invention will become more apparent by describing in detail the preferred embodiment of the present invention with reference to the attached drawings in which.

DESCRIPTION OF THE PREFERRED EMBODIMENT

Now the present invention will be described in detail referring to the attached drawings.

Figure 1:
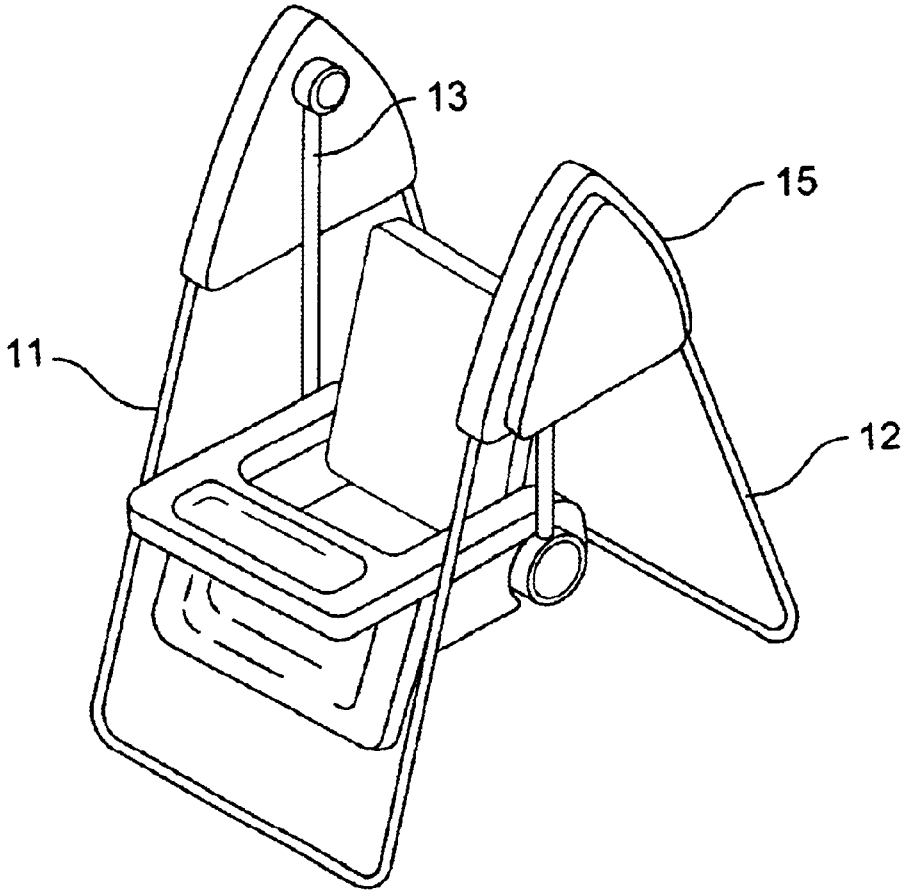
FIG. 1 is a perspective view showing the overall constitution of the swing according to the present invention.

As shown in FIG. 1, the swing according to the present invention includes: an A-shaped frame 12 arbitrarily set on the ground and having a pair of peaks; a swing seat 11 supported by a pair of supporting bars 13, the supporting bars 13 being supported to the pair of the peaks respectively; a pair of oscillation shafts 18 for oscillating to left and right interlocked to a pair of supporting bars 13; a pair of oscillators 19 secured to lower ends of the oscillation shafts 18 respectively; a pair of electromagnets 14*a* and 14*b* disposed at left and right sides of each of the oscillators 19; a sensor 16 for sensing the movements of the oscillator 19; and a control panel 24 for selectively carrying out the actuations of the swing.

Figure 2:
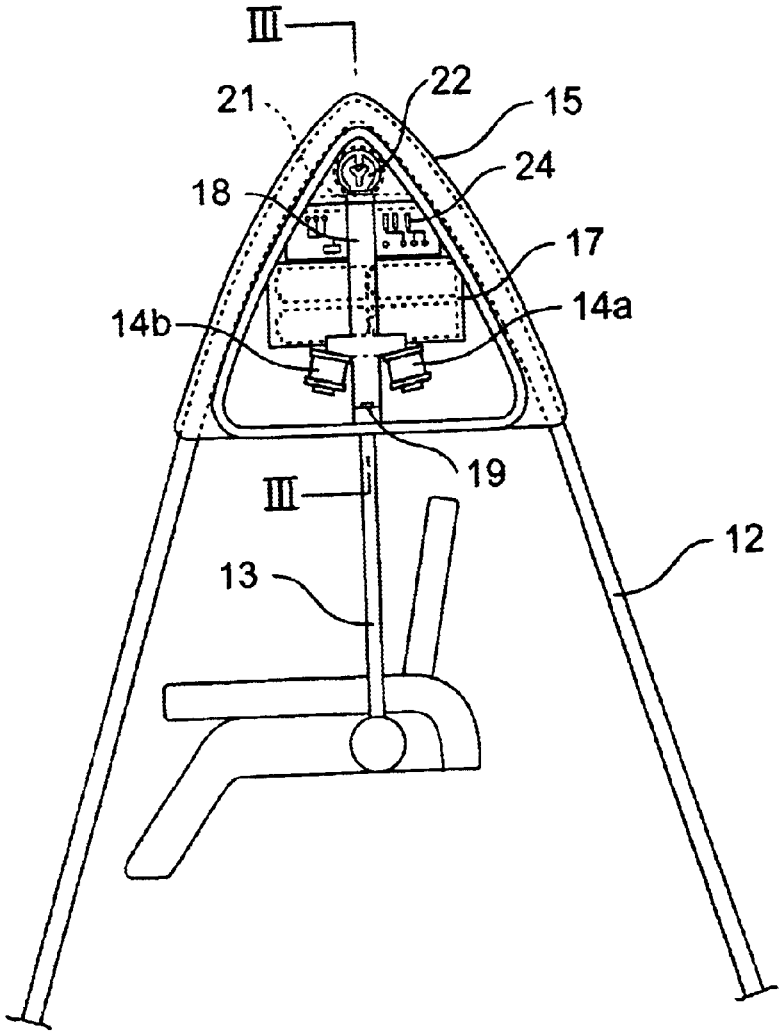
FIG. 2 illustrates the actuation and the constitution details of the swing according to the present invention.
Figure 3:
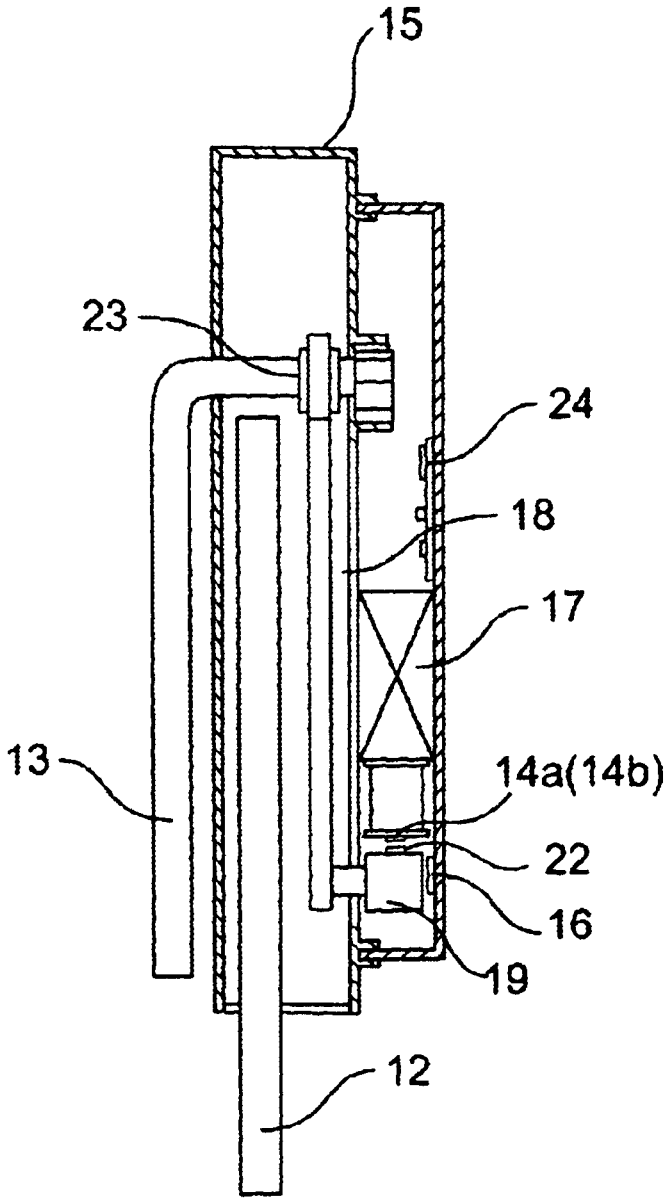
FIG. 3 is a side sectional view of the swing according to the present invention.
Figure 4:
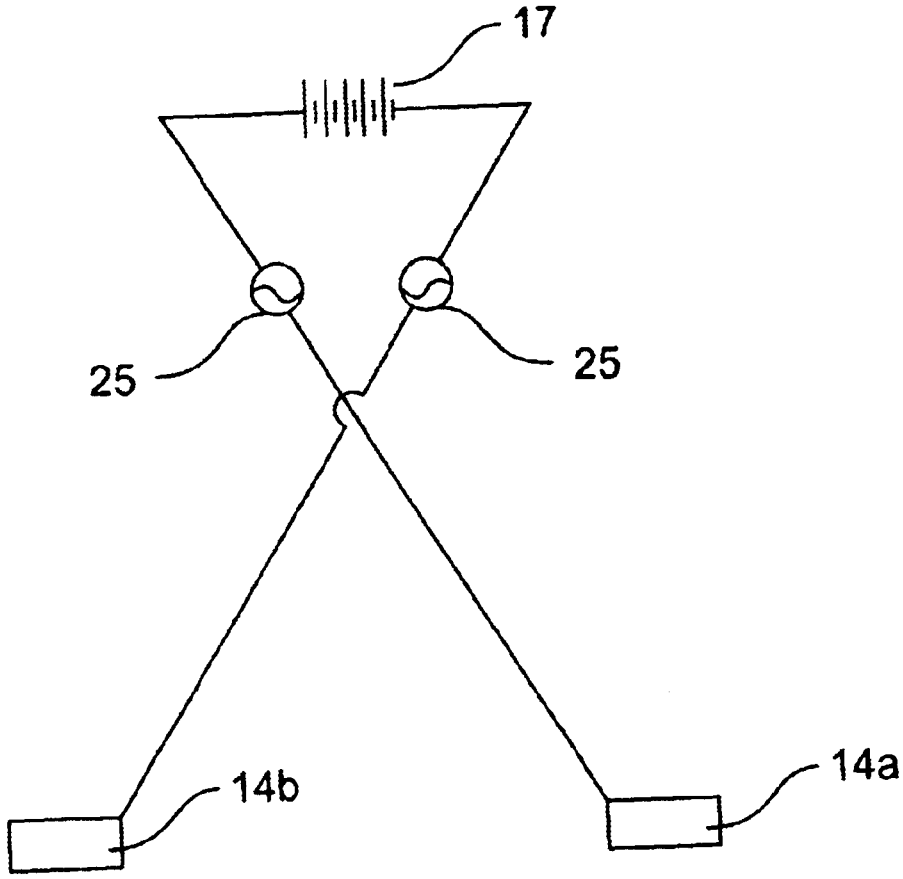
FIG. 4 is a circuit diagram of the swing according to the present invention.

FIG. 1 is a perspective view showing the overall constitution of the swing according to the present invention. FIG. 2 illustrates the actuation structure and the control part of the swing according to the present invention. FIG. 3 illustrates the power transmission mechanism of the swing according to the present invention.

The swing seat 11 is suspended from the peaks of the frame 12 so as to be swung. As shown in FIGS. 1 and 2, each of the supporting bars 13 for supporting the swing seat 11 extends upward to be pivotally secured to a securing bar 21 of each of the peaks of the frame 12.

An extended portion (extended downward) of each of the supporting bars 13 is integrally connected to the oscillation shaft 18, an oscillator 19 being fixed to the lower end of each of the oscillation shafts 18.

At the left and right sides of the oscillator 19, there are disposed a pair of electromagnets 14*a* and 14*b*, and when an electric power is alternately supplied to the pair of the electromagnets 14*a* and 14*b*, the oscillator 19 repeatedly swings between electromagnets 14*a* and 14*b*.

That is, if the oscillator 19 moves toward the right electromagnet 14*a*, the electric power is supplied to the left electromagnet 14*b* so as to reverse the motion of the oscillator 19 toward the left electromagnet 14*b*, while if the oscillator 19 moves toward the left electromagnet 14*b*, then the electric power is supplied to the right electromagnet 14*a* so as to reverse the motion of the oscillator 19 toward the right electromagnet 14*a*.

A pair of boxes 15 are formed to respectively accommodate the securing bars 21 (on which the connecting portion between the supporting bar 13 and the oscillation shaft 18 is mounted) and the upper portions of the frame 12. The box further includes: sensors 16 for sensing the swinging velocity, a timer, and the crying of the child; and a control panel 24 for controlling the generation of melodies.

Now the present invention will be described based on an example.

Regarding the environment recognition of an infant, the infant cannot recognize the abruptly changed environment (changed from the womb of the mother), and therefore, it is desirable that an environment similar to the womb of the mother is given to the infant. That is, when the infant is present within the womb of the mother, the mother performs very much movements, and therefore, the infant is accustomed to movements. In consideration of this an indoor swing for infants came to be developed. Generally, however, an infant's swing is oscillated with a human hand, but the manual swinging is very troublesome.

In consideration of this, the swing of the present invention is developed. In the present invention, if a pull or push is done only once, then the swinging is done continuously.

As shown in FIGS. 1 and 2, the swing seat 11 is secured to the pair of the supporting bars 13 which are respectively suspended from the peak portions of the frame 12.

The pair of the supporting bars 13 which support the swing seat 11 extend upward from the swing seat 11 to be bent rectangularly so as to extend beyond the frame 12. Thus the supporting bar 13 is pivotally secured to the securing bar 21 of the frame 12, in such a manner that the bent horizontal portion of the supporting bar 13 should generate the minimum frictions when swinging. The horizontally bent portion of the supporting bar 13 is bent rectangularly again to extend downward so as to form the oscillation shaft 18. The oscillator 19 is attached on the lower end of each of the oscillation shafts 18, and a contact member 22 protrudes inward from the oscillator 19.

As shown in FIG. 2, the box 15 contains: a power source 17 for driving the swing; a pair of electromagnets 14*a* and 14*b*; a sensor for sensing the frequency of the switching of the power; an oscillator 19 with a contact member 22 formed thereon, and for swinging between the two electromagnets 14*a* and 14*b* to activate the sensor 16; an oscillation shaft 18 with the oscillator 19 attached thereon; and a control panel 24 for controlling the actuation of the swing by responding to the oscillation velocity, the oscillation time, and the crying of the infant.

At certain distances from the oscillator 19 to the left and right sides, there are disposed the electromagnets 14*a* and 14*b* secured onto the box 15.

The power is a DC power, and the alternate swinging of the oscillator 19 is done in the following manner. That is, when the oscillator 19 is positioned at the right electromagnet, the contact member 22 of the oscillator activates the sensor 16 to withhold the power from the right electromagnet 14*a* by means of an automatic switch 25 and to supply the power to the left electromagnet 14*b*, resulting in that the motion of the oscillator 19 is reversed to be swung to the left electromagnet 14*b*.

This operation is controlled by the control panel 24.

The control panel 24 controls as to how long the oscillator 19 will actuate, and at what velocity it will swing.

The supporting bar 13 is formed integrally with the oscillation shaft 18, and therefore, if the swing seat 11 supported by the pair of the supporting bars 13 is swung to a certain angular range, then the oscillation shafts 18 are also swung to a certain angular range. If the supporting bars 13 are swung, then the pair of the oscillators 18 are also swung to the same angular range. If the electric power is supplied, and if the swing seat 11 is pulled or pushed to any direction only once, then the supporting bars 13 move so much. If the supporting bars 13 move so, then the pair of the oscillation shafts 18 move so much toward one of the electromagnets 14*a* and 14*b*.

That is, the pair of the oscillators 19 move toward any one of the electromagnets 14*a* and 14*b*, and therefore, they form a certain angle relative to the direction of gravity. The contact member 22 of the oscillator 19 which is installed on the lower end of the oscillation shaft 18 contacts to any one of the two sensors 16, and then the corresponding electromagnet loses the power so as to lose the magnetic force.

Under this condition, a spring 23 which is fitted around the horizontal portion of the oscillation shaft 18 (the oscillation shaft 18 being swung by being secured to the securing bar 21) elastically presses the oscillation shaft 18.

If the oscillation shaft 18 moves rightward, then the contact member 22 of the oscillator 19 contacts to the right sensor 16, while the power is supplied to the left electromagnet 14*b*. On the other hand, if the oscillator 19 moves leftward, then the contact member 22 contacts to the left sensor 16, while the right electromagnet 14*a* is magnetized. Then if the oscillator 19 is positioned at the right side, then the left electromagnet 14*b* is magnetized, while if the oscillator 19 is positioned at the left side, then the right electromagnet 14*a* is magnetized.

If the oscillator 19 initially moves to a certain distance by an external force, and if the external force is dissipated at a certain time point, the oscillator 19 withdraws toward the gravity line owing to the weight of the oscillator 19, while the opposite electromagnet 14*a* is electrified to form a magnetic field there. Accordingly the oscillator 19 moves continuously toward the opposite electrified electromagnet 14*a*. If the moving oscillator 19 approaches the electromagnet 14*a*, then the contact between the left sensor 16 and the contact member 22 is realized, and therefore, the left electromagnet 14*b* is magnetized to cause the oscillator 19 to move leftward. These actuations are repeatedly done, and therefore, the swing seat 11 performs the continuous swinging.

According to the present invention as described above, the swing can be swung continuously after one external push or pull, and therefore, the person who is caring the infant not only can take rest, but also can do other works while taking care of the infant. This is further enhanced by the automatic sensing functions such as detection of the crying of the infant and the like.

What is claimed is:

1. A swing comprising:

an A-shaped frame arbitrarily set on a ground and having a pair of symmetric peaks; and a swing seat supported to a pair of supporting bars, the supporting bars being supported to a pair of securing bars respectively;

the swing further comprising:

a pair of oscillation shafts respectively and integrally bent down from the securing bars, for oscillating to left and right together with the pair of the supporting bars respectively;

a pair of oscillators secured to lower ends of the oscillation shafts respectively;

a pair of springs installed between the frame and the oscillation shafts respectively, for furnishing an elastic force; and a pair of electromagnets and disposed at left and right sides of each of the oscillators.

2. The swing as claimed in claim 1, wherein the electromagnets and alternately gain and lose magnetic fluxes owing to a pair of left and right sensors, when the oscillator swings leftward and rightward.

3. The swing as claimed in claim 1, further comprising: a control panel for controlling a time period and velocity of the swing.

4. The swing as claimed in claim 1, wherein during a standstill of the swing, the control panel senses crying of an infant to activate the swing and to output music.

* * * * *